US008368618B2

(12) United States Patent
Choi

(10) Patent No.: US 8,368,618 B2
(45) Date of Patent: Feb. 5, 2013

(54) ORGANIC LIGHT EMITTING DISPLAY DEVICE

(75) Inventor: Sang-Moo Choi, Suwon-si (KR)

(73) Assignee: Samsung Display Co., Ltd., Giheung-Gu, Yongin, Gyeonggi-Do (KR)

( * ) Notice: Subject to any disclaimer, the term of this patent is extended or adjusted under 35 U.S.C. 154(b) by 632 days.

(21) Appl. No.: 12/588,013

(22) Filed: Sep. 30, 2009

(65) Prior Publication Data

US 2010/0156762 A1 Jun. 24, 2010

(30) Foreign Application Priority Data

Dec. 19, 2008 (KR) ..... 10-2008-0129967

(51) Int. Cl.
*G09G 3/30* (2006.01)

(52) U.S. Cl. ..... 345/76; 315/169.3

(58) Field of Classification Search ..... None
See application file for complete search history.

(56) References Cited

U.S. PATENT DOCUMENTS

| | | | | |
|---|---|---|---|---|
| 7,382,340 | B2 * | 6/2008 | Kim et al. | 345/76 |
| 2004/0100203 | A1 * | 5/2004 | Kobayashi et al. | 315/169.3 |

FOREIGN PATENT DOCUMENTS

| | | | |
|---|---|---|---|
| JP | 2007-140318 | | 6/2007 |
| JP | 2008-026467 | | 2/2008 |
| KR | 1020050020673 | A | 3/2005 |
| KR | 10-2007-0112714 | | 11/2007 |
| KR | 10-2008-0004960 | A | 1/2008 |
| KR | 10-2008-0016115 | A | 2/2008 |
| KR | 10-2008-0060169 | A | 7/2008 |

OTHER PUBLICATIONS

Korean Office action issued by KIPO, dated Feb. 25, 2011, corresponding to Korean Patent Application No. 10-2008-0129967, together with Request for Entry.

The Korean Office action issued by Korean Patent Office on Jul. 27, 2011, corresponding to KR 10-2008-0129967 and Request for Entry attached herewith.

* cited by examiner

*Primary Examiner* — Jason Olson
(74) *Attorney, Agent, or Firm* — Robert E. Bushnell, Esq.

(57) ABSTRACT

An organic light emitting display (OLED) device capable of compensating for threshold voltage of a driving transistor in which this OLED device uses a scan driver to sequentially supply scan signals to scan lines. A data driver supplies data signals to data lines when the scan signals are supplied with pixels positioned at the intersections of the scan lines and the data lines. A common circuit unit formed in every horizontal line, receiving one or more external power sources required in driving the pixels and transferring the received external power to pixels positioned in the same horizontal lines.

18 Claims, 5 Drawing Sheets

ORGANIC LIGHT EMITTING DISPLAY DEVICE

CLAIM OF PRIORITY

This application makes reference to, incorporates the same herein, and claims all benefits accruing under 35 U.S.C. §119 from an application earlier filed in the Korean Intellectual Property Office on Dec. 19, 2008 and there duly assigned Serial No. 10-2008-0129967.

BACKGROUND OF THE INVENTION

1. Field of the Invention

The present invention relates to an organic light emitting display device, and more particularly to an organic light emitting display device capable of compensating for threshold voltage of a driving transistor.

2. Discussion of Related Art

Recently, various flat panel display devices having reduced weight and volume over cathode ray tubes have been developed. The flat panel display devices include a liquid crystal display device, a field emission display device, a plasma display panel, an organic light emitting display device, etc.

Among others, the organic light emitting display device displays images by using an organic light emitting diode generating light by means of recombination of electrons and holes. The organic light emitting display device has advantages of being driven with low power consumption and having rapid response speed.

However, the conventional organic light emitting display device has a problem that an image having a uniform brightness cannot be displayed due to threshold voltage deviation. Therefore, what is needed is an organic light emitting display device capable of compensating for threshold voltage of a driving transistor.

The above information disclosed in this Related Art section is only for enhancement of understanding of the background of the invention and therefore it may contain information that does not form the prior art that is already known to a person of ordinary skill in the art.

SUMMARY OF THE INVENTION

Therefore, it is an object of the present invention to provide an organic light emitting display device capable of compensating for threshold voltage of a driving transistor.

In order to accomplish the above object, according to an embodiment of the present invention, there is provided an organic light emitting display device including: a scan driver sequentially supplying scan signals to scan lines; a data driver supplying data signals to data lines when the scan signals are supplied; pixels positioned at the intersections of the scan lines and the data lines; and a common circuit unit formed in every horizontal line, receiving power form one or more external power sources required in driving the pixels and transferring the received external power to pixels positioned in the same horizontal lines.

Preferably, the respective pixels positioned in an $i^{th}$ (i is a natural number) horizontal line include: an organic light emitting diode whose cathode electrode is connected to a second power supply; a first transistor whose first electrode is connected to the common circuit unit and second electrode is connected to an anode electrode of the organic light emitting diode to control the amount of current supplied to the organic light emitting diode; a second transistor connected between the data line and a gate electrode of the first transistor and turned on when a scan signal is supplied to an $i^{th}$ scan line; a third transistor connected between the first electrode of the first transistor and the gate electrode thereof and turned on when a scan signal is supplied to an $i-1^{st}$ scan line; a first capacitor connected between the gate electrode of the first transistor and the anode electrode of the organic light emitting diode; and a second capacitor connected between the anode electrode of the organic light emitting diode and a fixed power supply.

The scan driver sequentially supplies light emitting control signals having voltage at which transistors are turned off to light emitting control lines. A light emitting control signal supplied to an $i^{th}$ light emitting control line overlaps with a scan signal supplied to an $i-2^{nd}$ scan line, the $i-1^{st}$ scan line and the $i^{th}$ scan line. The common circuit unit positioned in the $i^{th}$ horizontal line includes a first common transistor connected between a first power supply and the first electrode of the first transistor and turned off when a light emitting control signal is supplied to the $i^{th}$ light emitting control line; a second common transistor connected between an initial power supply and the first electrode of the first transistor and turned on when a scan signal is supplied to the $i-2^{nd}$ scan line; and a third common transistor connected between a reference power supply and the first electrode of the first transistor and turned on when a scan signal is supplied to the $i-1^{st}$ can line.

With the organic light emitting display device according to the present invention, an image having uniform brightness can be display, regardless of threshold voltage of the driving transistor included in the respective pixels. Also, in the present invention, driving power is supplied to the pixels using the common circuit units formed on every horizontal line. In this case, the transistors for supplying driving power can be removed from the inside of the pixels, thereby having advantages that the manufacturing costs can be reduced and the structure thereof can be simplified.

BRIEF DESCRIPTION OF THE DRAWINGS

A more complete appreciation of the invention, and many of the attendant advantages thereof, will be readily apparent as the same becomes better understood by reference to the following detailed description when considered in conjunction with the accompanying drawings in which like reference symbols indicate the same or similar components, wherein.

DETAILED DESCRIPTION OF PREFERRED EMBODIMENTS

Figure 1:
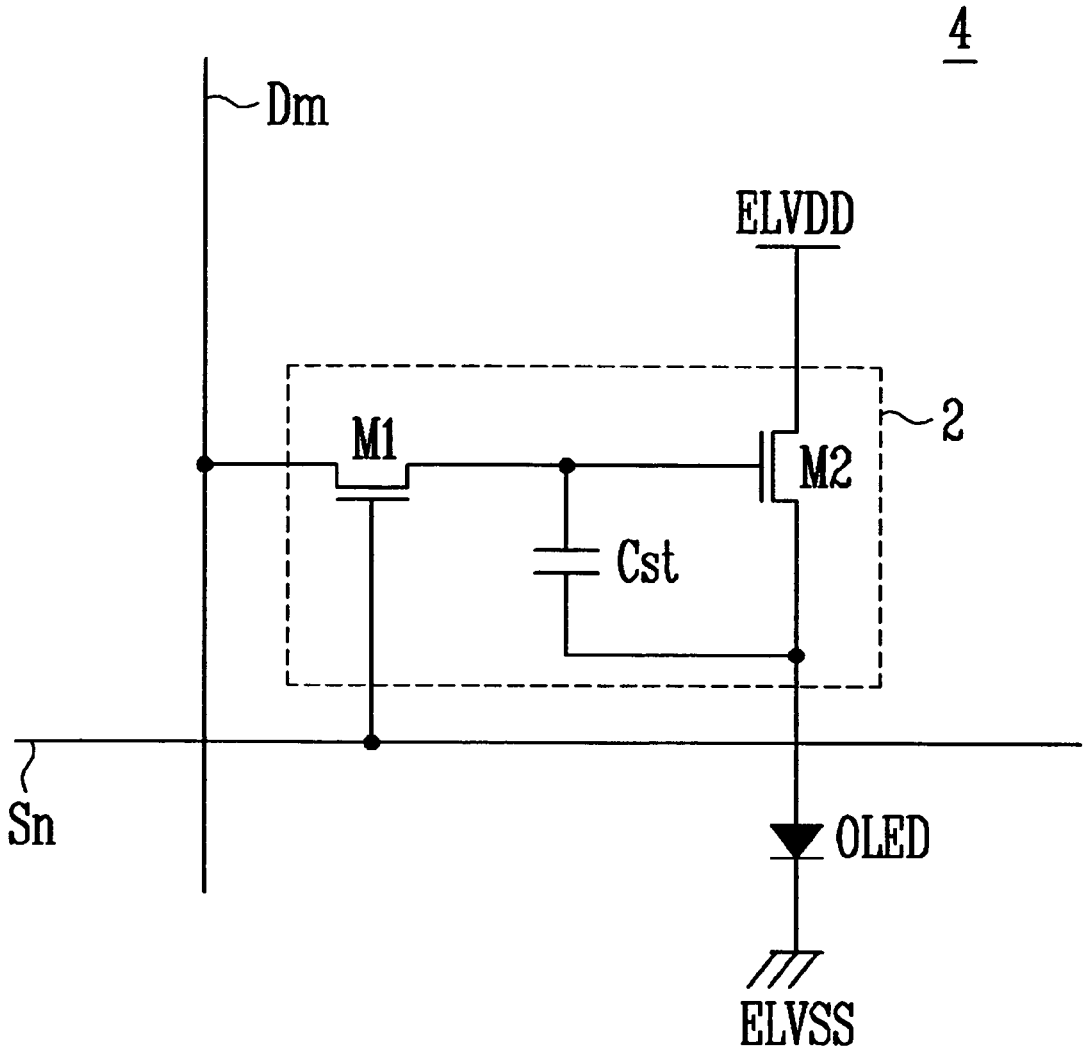
FIG. 1 is a circuit diagram showing a pixel of a general organic light emitting display device.

Hereinafter, certain exemplary embodiments according to the present invention will be described with reference to the accompanying drawings. Here, when a first element is described as being coupled to a second element, the first element may be not only directly coupled to the second element but may also be indirectly coupled to the second element via a third element. Further, some of the elements that are not essential to the complete understanding of the invention are omitted for clarity. Also, like reference numerals refer to like elements throughout.

The present invention will be described more fully hereinafter with reference to the accompanying drawings, in which exemplary embodiments of the invention are shown. As those skilled in the art would realize, the described embodiments may be modified in various different ways, all without departing from the spirit or scope of the principles for the present invention.

Recognizing that sizes and thicknesses of constituent members shown in the accompanying drawings are arbitrarily given for better understanding and ease of description, the present invention is not limited to the illustrated sizes and thicknesses.

In the drawings, the thickness of layers, films, panels, regions, etc., are exaggerated for clarity. Like reference numerals designate like elements throughout the specification. It will be understood that when an element such as a layer, film, region, or substrate is referred to as being "on" another element, it can be directly on the other element or intervening elements may also be present. Alternatively, when an element is referred to as being "directly on" another element, there are no intervening elements present.

In order to clarify the present invention, elements extrinsic to the description are omitted from the details of this description, and like reference numerals refer to like elements throughout the specification.

In several exemplary embodiments, constituent elements having the same configuration are representatively described in a first exemplary embodiment by using the same reference numeral and only constituent elements other than the constituent elements described in the first exemplary embodiment will be described in other embodiments.

FIG. 1 is a circuit diagram showing a pixel of a general organic light emitting display device. In FIG. 1, transistors included in pixels are set as an NMOS transistor.

Referring to FIG. 1, the pixel 4 of the conventional organic light emitting display device includes an organic light emitting diode OLED and a pixel circuit 2 coupled to a data line Dm and a scan line Sn to control the organic light emitting diode OLED.

An anode electrode of the organic light emitting diode OLED is connected to the pixel circuit 2, and a cathode electrode thereof is connected to a second power supply ELVSS. The organic light emitting diode OLED as above generates light having a predetermined brightness by corresponding to current supplied from the pixel circuit 2.

The pixel circuit 2 controls the amount of current supplied to the organic light emitting diode OLED by corresponding to a data signal supplied to the data line Dm when a scan signal is supplied to the scan line Sn. To this end, the pixel circuit 2 includes a second transistor M2 (that is, a driving transistor) connected between a first power supply ELVDD and the organic light emitting diode OLED, a first transistor M1 connected among the second transistor M2, the data line Dm and the scan line Sn, and a storage capacitor Cst connected between a gate electrode and a second electrode of the second transistor M2.

A gate electrode of the first transistor M1 is connected to the scan line Sn, and a first electrode thereof is connected to the data line Dm. A second electrode of the first transistor M1 is connected to one terminal of the storage capacitor Cst. Here, the first electrode is set as any one of a source electrode and a drain electrode, and the second electrode is set as an electrode other than the first electrode. For example, if the first electrode is set as a drain electrode, the second electrode is set as a source electrode. When the scan signal is supplied from the scan line Sn, the first transistor M1 connected to the scan line Sn and the data line Dm is turned on to supply the data signal supplied from the data line Dm to the storage capacitor Cst. At this time, the storage capacitor Cst is charged with voltage corresponding to the data signal.

A gate electrode of the second transistor M2 is connected to one terminal of the storage capacitor Cst and a first electrode thereof is connected to the first power supply ELVDD. A second electrode of the second transistor M2 is connected to the other terminal of the storage capacitor Cst and the anode electrode of the organic light emitting diode OLED. The second transistor M2 as above controls the amount of current flowing onto a second power supply ELVSS from the first power supply ELVDD via the organic light emitting diode OLED by corresponding to the voltage value stored in the storage capacitor Cst.

One terminal of the storage capacitor Cst is connected to the gate electrode of the second transistor M2 and the other terminal thereof is connected to the anode electrode of the organic light emitting diode OLED. The storage capacitor Cst as above is charged with voltage corresponding to the data signal.

The conventional pixel 4 as above supplies the current corresponding to the voltage charged in the storage capacitor Cst to the organic light emitting diode OLED, thereby displaying an image having a predetermined brightness. Actually, when threshold voltage of the second transistor M2 is set to be different in each pixel 4, each pixel 4 generates light having different brightness corresponding to the same data signal so that images having uniform brightness cannot be displayed.

Hereinafter, the present invention will be described in more detail with reference to FIGS. 2 to 8 attached with exemplary embodiments so that a person having ordinary skill in the art to which the present invention pertains can readily carry out the present invention.

Figure 2:
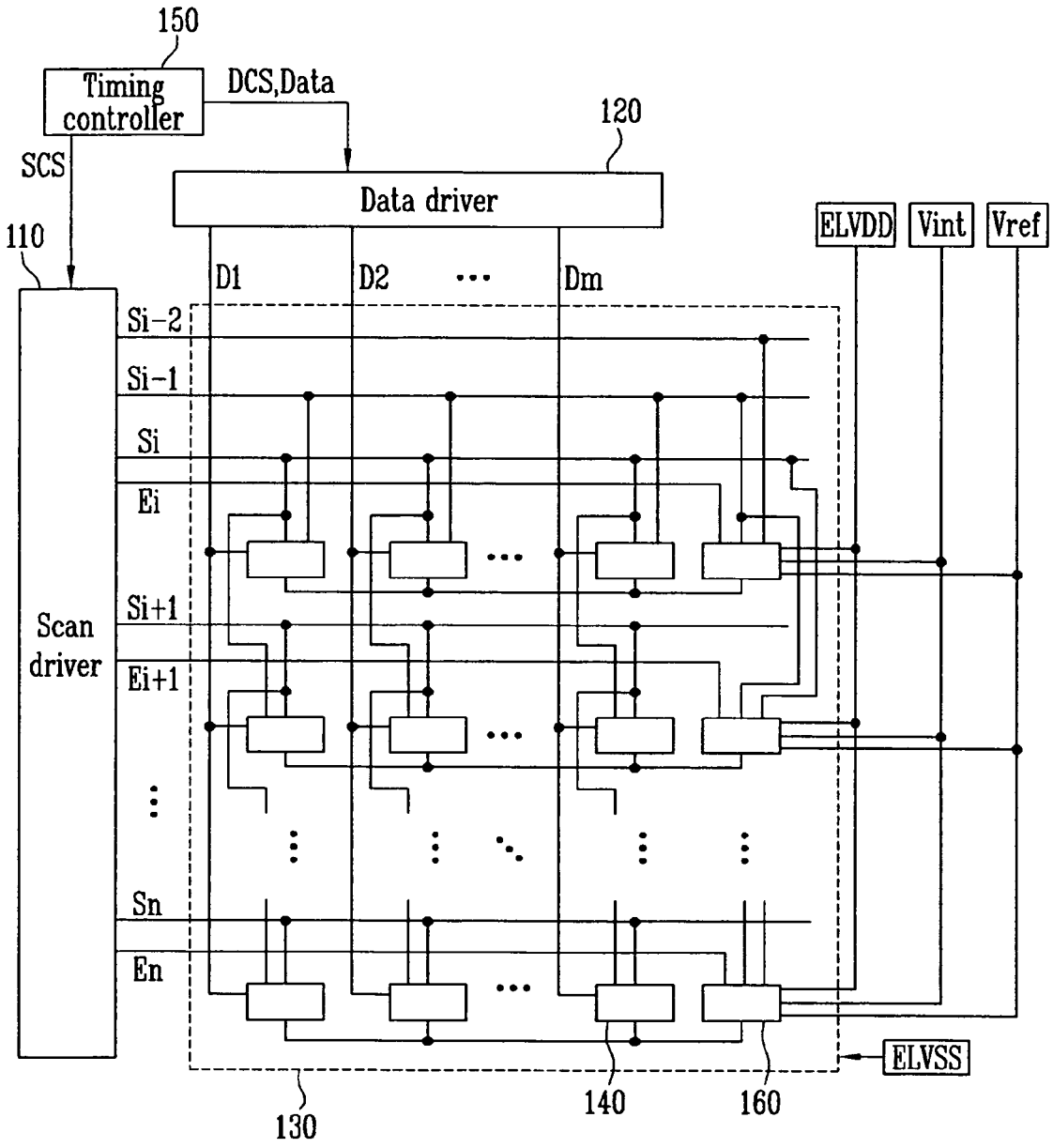
FIG. 2 shows an organic light emitting display device according to an embodiment of the present invention.

FIG. 2 shows an organic light emitting display device according to an embodiment of the present invention. For convenience of explanation, i−2$^{nd}$ (i is an natural number) scan line Si−2 to n$^{th}$ scan line Sn will be described in FIG. 2.

Referring to FIG. 2, the organic light emitting display according to the embodiment of the present invention includes pixels 140 positioned in the intersections of scan lines Si to Sn and data lines D1 to Dm, common circuit units formed on each horizontal line and transferring powers. ELVDD, Vint and Vref supplied from the external to the pixels 140 positioned in the sane horizontal line, a scan driver 110 driving scan lines Si−2 to Sn and light emitting control lines Ei to En, a data driver 120 driving the data lines D1 to Dm, and a timing controller 150 controlling the scan driver 110 and the data driver 120.

The scan driver 110 receives a scan driving control signal SCS from the timing controller 150. The scan driver 110 receiving the scan driving control signal SCS generates scan signals and supplies the generated scan signals sequentially to the scan lines Si−2 to Sn. Also, the scan driver 110 generates light emitting control signals and supplies the generated light emitting control signals sequentially to the light emitting control lines Ei to En. Here, the scan signals are set as voltage by which transistors can be turned on (for example, high voltage), and the light emitting control signals are set as voltage by which transistors can be turned off (for example, low voltage). The light emitting control signal supplied to an $i^{th}$ light emitting control line Ei is supplied overlappedly with scan signals supplied to an $i-2^{nd}$ scan line Si−2, an $i-1^{st}$ scan line Si−1 and an $i^{th}$ scan line Si.

The data driver 120 receives a data driving control signal DCS from the timing controller 150. The data driver 120 receiving the data driving control signal DCS supplies data signals to the data lines D1 to Dm to be synchronized with the scan signals.

The timing controller 150 generates the data driving control signal DCS and the scan driving control signal SCS by corresponding to the synchronization signals supplied from the external. The data driving control signal DCS generated in the timing controller 150 is supplied to the data driver 120, and the scan driving control signal SCS generated in the timing controller 150 is supplied to the scan driver 110. The timing controller 150 supplies data Data supplied from the external to the data driver 120.

The pixel unit 130 includes a plurality of pixels 140 and the common circuit units 160.

The respective pixels 140 include organic light emitting diodes (not shown) and generate light corresponding to the data signals. The pixels 140 as above include a plurality of NMOS transistors and supply current compensating for threshold voltage of the driving transistor to the organic light emitting diodes. To this end, the pixel 140 positioned in the $i^{th}$ horizontal line is connected to the $i-1^{st}$ scan line Si−1 and the $i^{th}$ scan line Si. Also, the pixel 140 positioned in the $i^{th}$ horizontal line receives driving power from the common circuit unit 160 positioned in the $i^{th}$ horizontal line.

One common circuit units 160 is formed in every horizontal line one by one. The common circuit units 160 as above receive the first power ELVDD, the initial power Vint, and the reference power Vref, and supply any one of the received power to the pixels 140 positioned in the same horizontal line. To this end, the common circuit unit 160 positioned in the $i^{th}$ horizontal line is connected to the $i-2^{nd}$ scan line Si−2, the $i-1^{st}$ scan line Si−1, and the $i^{th}$ light emitting control line Ei.

Meanwhile, the first power ELVDD is set to have a voltage value higher than the initial power Vint and the reference voltage Vref. The reference voltage Vref is set to have voltage higher than the initial voltage Vint and lower than the data signals. Actually, the reference voltage Vref is set to have voltage that the voltage obtained by subtracting the threshold voltage of the driving transistor from the reference voltage Vref (that is, Vref−Vth) is lower than the threshold voltage of the organic light emitting diode.

Figure 3:
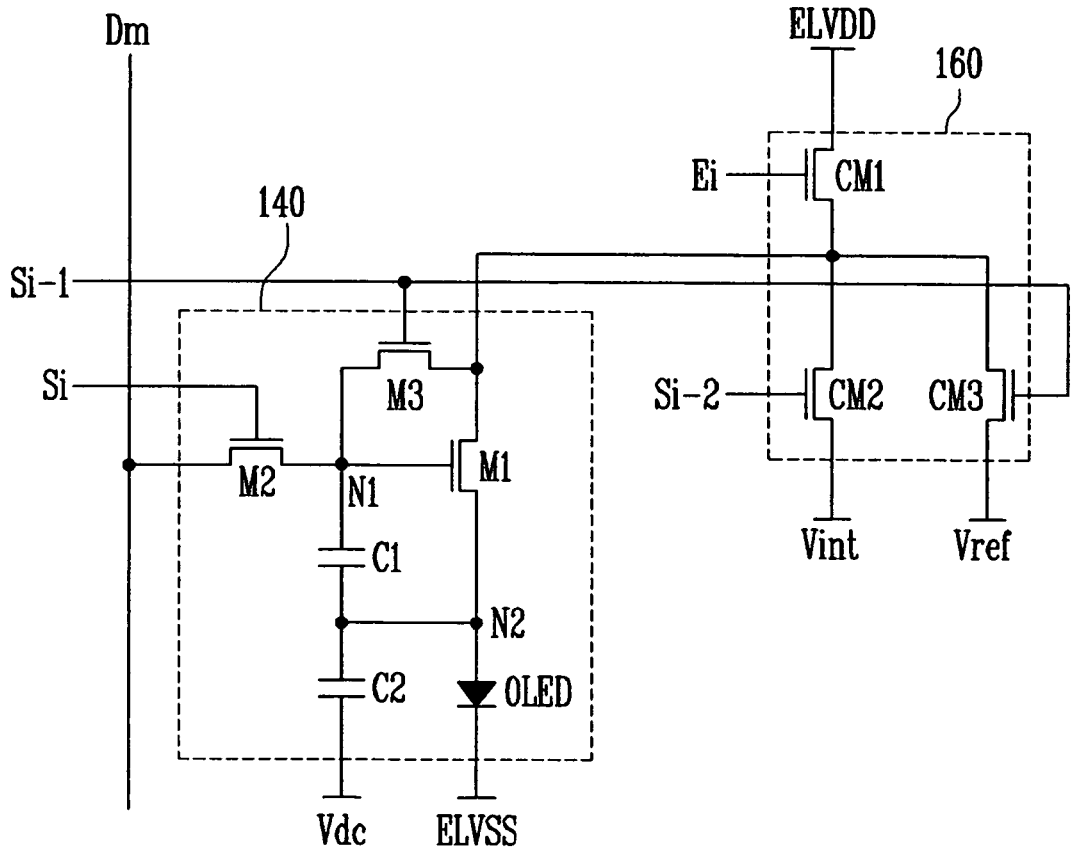
FIG. 3 shows a pixel and a common circuit unit according to a first embodiment of the present invention.

FIG. 3 shows a common circuit unit and a pixel according to a first embodiment of the present invention. For convenience of explanation, the common circuit unit and the pixel positioned in an $i^{th}$ horizontal line will be described in FIG. 3.

Referring to FIG. 3, the pixel 140 according to the first embodiment of the present invention includes a first transistor to a third transistor M1 to M3, a first capacitor C1, a second capacitor C2, and an organic light emitting diode OLED.

An anode electrode of the organic light emitting diode OLED is connected to a second electrode of the first transistor M1 and a cathode electrode thereof is connected to a second power ELVSS. The organic light emitting diode OLED generates light by corresponding to current supplied from the first transistor M1.

A first electrode of the first transistor M1 is connected to the common circuit unit 160 and a second electrode thereof is connected to the anode electrode (that is, a second node N2) of the organic light emitting diode OLED. A gate electrode of the first transistor M1 is connected to a first node N1. The first transistor M1 as above supplies the current corresponding to the voltage applied to the first node N1 to the organic light emitting diode OLED.

A gate electrode of the second transistor M2 is connected to the $i^{th}$ scan line Si and a first electrode thereof is connected to the data line Dm. A second electrode of the second transistor M2 is connected to the first node N1 (that is, the gate electrode of the first transistor M1). When the scan signal is supplied to the $i^{th}$ scan line Si, the second transistor M2 as above is turned on to electrically connect the data line Dm to the first node N1.

A gate electrode of the third transistor M3 is connected to the $i-1^{st}$ scan line S−1 and a first electrode thereof is connected to the first electrode of the first transistor M1. A second electrode of the third transistor M3 is connected to the first node N1. When the scan signal is supplied to the $i-1^{st}$ scan line Si−1, the third transistor M3 as above is turned on to electrically connect the gate electrode of the first transistor M1 to the first electrode thereof.

The first capacitor C1 is connected between the first node N1 and the second node N2 (that is, the anode electrode of the organic light emitting diode). The first capacitor C1 as above is charged with threshold voltage and the voltage corresponding to the data signal.

The second capacitor C2 is connected between the second node N2 and a fixed power supply Vdc. When the voltage of the data signal is supplied to the first node N1, the second capacitor C2 as above controls the voltage rising of the second node N2 to allow the first capacitor C1 to be charged with voltage corresponding to the data signal.

Meanwhile, the fixed power Vdc, which is direct current voltage, may be set to have various voltage values. For example, the fixed power supply Vdc may be set to have the same voltage as the second power supply ELVSS.

The common circuit unit 160 includes a first common transistor CM1 connected between a first power supply ELVDD and the first electrode of the first transistor M1, a second common transistor CM2 connected between an initial power supply Vint and the first electrode of the first transistor M1, and a third common transistor CM3 connected between a reference power supply Vref and the first electrode of the first transistor M1.

A gate electrode of the first common transistor CM1 is connected to an $i^{th}$ light emitting control line Ei. The first common transistor CM1 as above is turned on when the light emitting control signal is supplied to the $i^{th}$ light emitting control line Ei, and is turned off in other cases.

A gate electrode of the second common transistor CM2 is connected to an $i-2^{nd}$ scan line Si−2. The second common transistor CM2 as above is turned on when the scan signal is supplied to the $i-2^{nd}$ scan line Si−2.

A gate electrode of the third common transistor CM3 is connected to an $i-1^{st}$ scan line Si−1. The third common transistor CM3 as above is turned on when the scan signal is supplied to the $i-1^{st}$ scan line Si−1.

Figure 4:
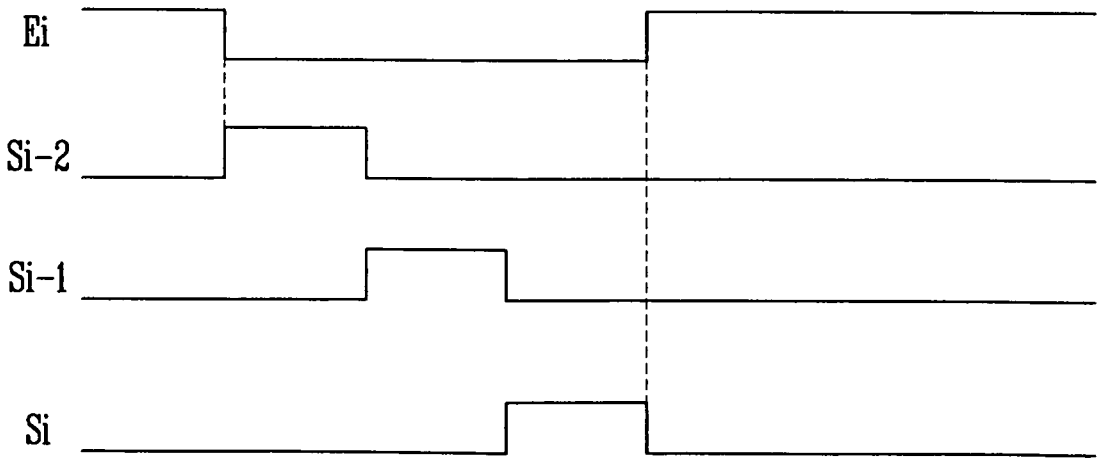
FIG. 4 is a waveform view showing a driving method of the pixel and the common circuit unit of FIG. 3.

FIG. 4 is a waveform view showing a driving method of the pixel and the common circuit unit of FIG. 3.

Describing an operation process in detail with reference to FIGS. 3 and 4, first, the light emitting control signal is supplied to the $i^{th}$ light emitting control line Ei, and the scan signal is supplied to the $i-2^{nd}$ scan line Si−2.

If the light emitting control signal is supplied to the $i^{th}$ light emitting control line Ei, the first common transistor CM1 is turned off If the scan signal is supplied to the $i-2^{nd}$ scan line Si−2, the second common transistor CM2 is turned on.

If the second common transistor CM2 is turned on, the voltage of the initial power supply Vint is supplied to the first electrode of the first transistor M1. Here, the initial voltage Vint is set to have low voltage (for example, voltage lower than the second power ELVSS) so that the first electrode of the first transistor M1 is set as a source electrode. In this case, current flows from the second node N2 to the initial power supply Vint and thus, the second node N2 is set as the voltage of the initial power supply Vint.

Thereafter, the scan signal is supplied to the i−1$^{st}$ scan line Si−1 so that the third transistor M3 and the third common transistor CM3 are turned on. If the third transistor M3 is turned on, the first electrode of the first transistor M1 is electrically connected to the gate electrode thereof. If the third common transistor CM3 is turned on, the voltage of the reference power supply Vref is supplied to the first electrode and the gate electrode of the first transistor M1.

Here, the first transistor M1 is connected in a diode shape so that the voltage of the second node N2 is raised to the voltage obtained by subtracting threshold voltage of the first transistor M1 from the voltage of the reference power supply Vref. In this case, the first transistor C1 is charged with the voltage corresponding to the threshold voltage of the first transistor M1. Meanwhile, the voltage obtained by subtracting threshold voltage of the first transistor M1 from the voltage of the reference power supply Vref is set as voltage lower than the threshold voltage of the organic light emitting diode OLED so that the organic light emitting diode OLED is not light-emitted.

Thereafter, the scan signal is supplied to the i$^{th}$ scan line SI so that the second transistor M2 is turned on. If the second transistor M2 is turned on, the data signal is supplied to the first node N1 from the data line Dm. Then, the voltage of the first node N1 is raised to the voltage of the data signal from the voltage of the reference power supply Vref. At this time, the voltage of the second node N2 is also raised by corresponding to the voltage rise of the first node N1. The voltage variation of the second node N2 is set as shown in equation 1 below.

$$\Delta N2=(V\text{data}-V\text{ref})\times C1/(C1+C2) \quad \text{[Equation 1]}$$

In the equation 1, Vdata represents the voltage of the data signal.

If the voltage variation of the second node N2 is set as shown in the equation 1, voltage Vgs(M1) between the gate electrode of the first transistor M1 and the source electrode thereof is set as shown in equation 2 below.

$$Vgs(M1)=(V\text{data}-V\text{ref})\times\{1-C1/(C1+C2)\}+V\text{th}(M1) \quad \text{[Equation 2]}$$

When the voltage of Vgs(M1) is set as shown in the equation 2, the current Ioled flowing onto the organic light emitting diode OLED is set as shown in equation 3 below.

$$I\text{oled}=\beta\times(Vgs-V\text{th}(M1))^2=\beta\{(V\text{data}-V\text{ref})\times\{1-C1/(C1+C2)\}\}^2 \quad \text{[Equation 3]}$$

In the equation 3, β means a constant value.

Referring to FIG. 3, the current Ioled flowing onto the organic light emitting diode OLED is determined, regardless of the threshold voltage of the first transistor M1. Therefore, in the present invention, an image having a desired brightness can be displayed, regardless of the threshold voltage of the first transistor M1.

Meanwhile, at least one of common transistors CM1, CM2, and CM3 included in the common circuit unit 160 can be included in the inside of the pixel 140.

Figure 5:
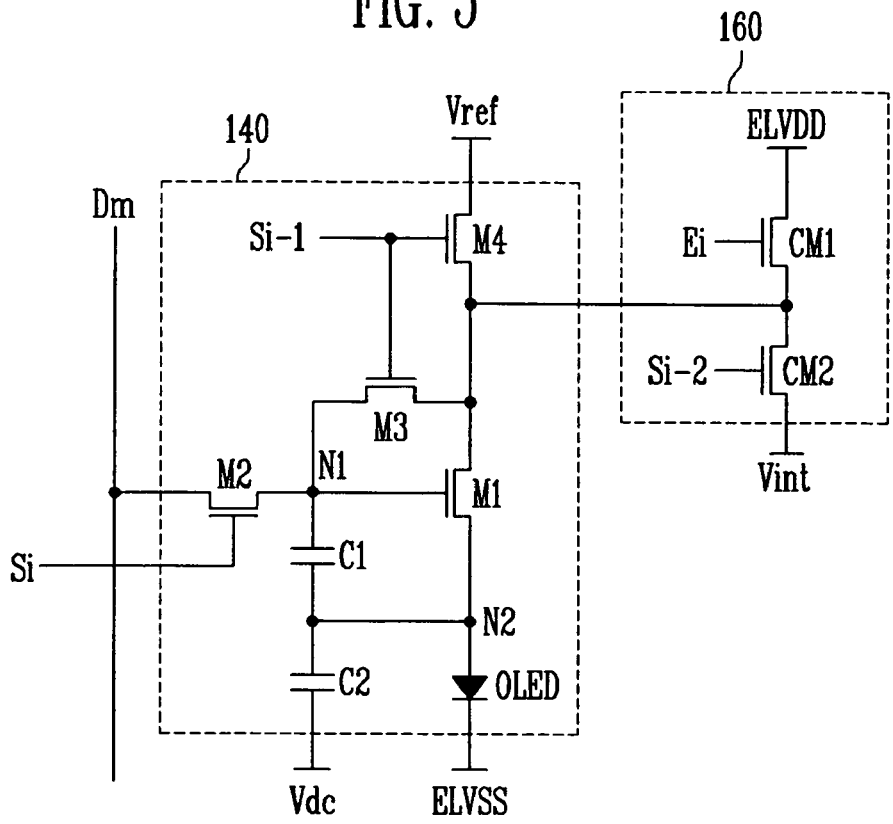
FIG. 5 shows a pixel and a common circuit unit according to a second embodiment of the present invention.

For example, a fourth transistor M4 included in the pixel 140 and positioned between the first electrode of the first transistor M1 and the reference power supply Vref may be formed, as shown in FIG. 5. The fourth transistor M4 as above performs the same function as the third common transistor CM3 as shown in FIG. 3. (In this case, the third common transistor CM3 included in the common circuit unit 160 is omitted.) In other words, when the scan signal is supplied to the i−1$^{st}$ scan line Si−1, the fourth transistor M4 is turned on to supply the voltage of the reference power supply Vref to the first electrode of the first transistor M1.

Figure 6:
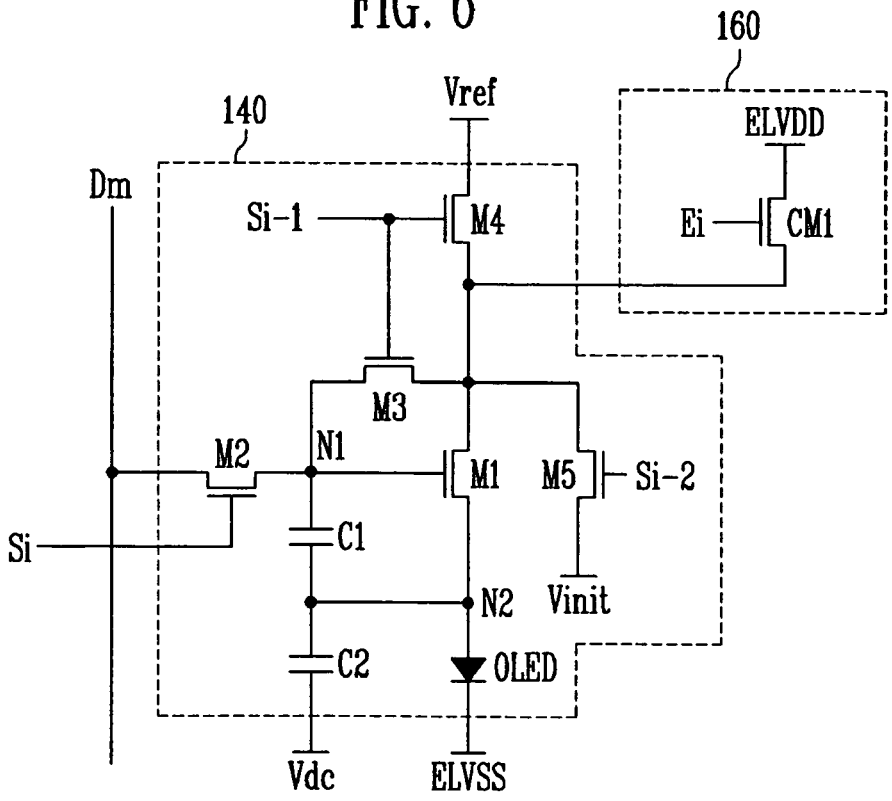
FIG. 6 shows a pixel and a common circuit unit according to a third embodiment of the present invention.

Also, in the present invention, a fifth transistor M5 positioned between the first electrode of the first transistor M1 and the initial power supply Vint may further be formed, as shown in FIG. 6. The fifth transistor M5 as above performs the same function as the second common transistor CM2 as shown in FIG. 3. (In this case; the second common transistor CM2 included in the common circuit unit 160 is omitted.) In other words, when the scan signal is supplied to the i−2$^{nd}$ scan line Si−2, the fifth transistor M5 is turned on to supply the voltage of the initial power supply Vint to the first electrode of the first transistor M1.

Figure 7:
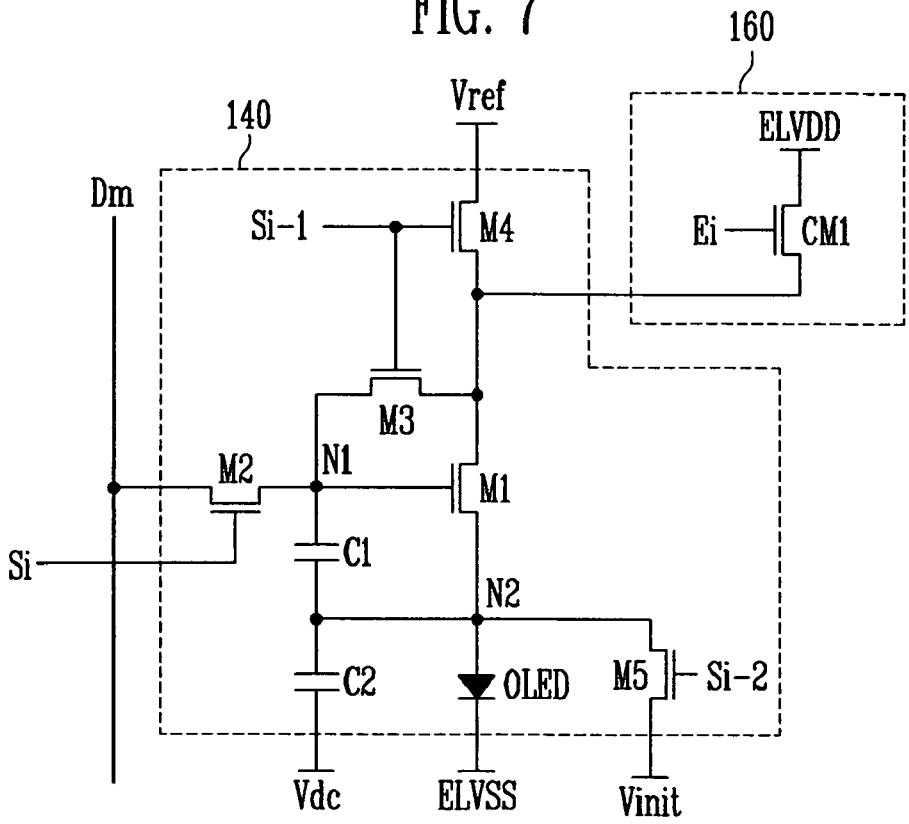
FIG. 7 shows a pixel and a common circuit unit according to a fourth embodiment of the present invention.

Meanwhile, the fifth transistor M5 may be formed between the second node N2 and the initial power supply Vint, as shown in FIG. 7. In this case, when the fifth transistor M5 is turned on, the initial power Vint is supplied directly to the second node N2.

Figure 8:
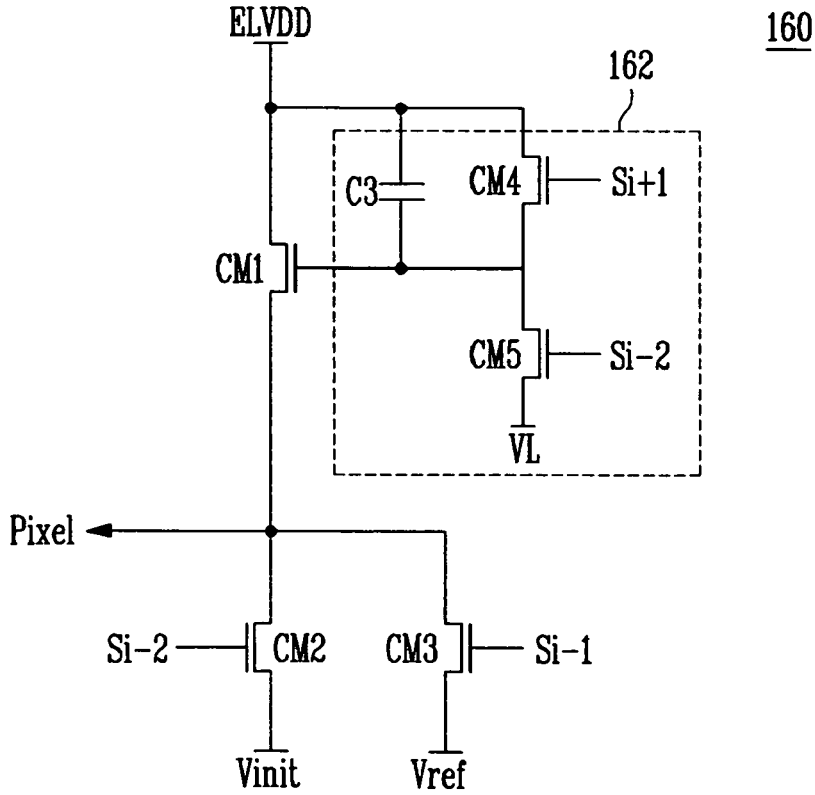
FIG. 8 shows a common circuit unit according to another embodiment of the present invention.

FIG. 8 shows another embodiment of a common circuit unit. In FIG. 8, the common circuit unit is constituted to be connected to scan lines, without using light emitting control lines. When explaining FIG. 8, the detailed description on the same constitution as FIG. 3 will be omitted and the same reference numerals thereon will be used.

Referring to FIG. 8, the common circuit unit 160 according to another embodiment of the present invention further includes a controller 162 controlling the turn-on and turn-off of the first common transistor CM1.

The controller 162 includes a fourth common transistor CM4, a fifth common transistor CM5, and a third capacitor C3.

The fourth common transistor CM4 and the fifth common transistor CM5 are connected in series between a power supply ELVDD and a low power supply VL. The common terminal between the fourth common transistor CM4 and the fifth common transistor CM5 is connected to the gate electrode of the first common transistor CM1. The third capacitor C3 is connected between the common terminal between the fourth common transistor CM4 and the fifth common transistor CM5 and the first power supply ELVDD.

The fourth common transistor CM4 is connected between the first power supply ELVDD and a gate electrode of the first common transistor CM1. The fourth common transistor CM4 as above is turned on when the scan signal is supplied to an i+1$^{st}$ scan line Si+1.

The fifth common transistor CM5 is connected between the gate electrode of the first common transistor CM1 and the low power supply VL. The fifth common transistor CM5 as above is turned on when the scan signal is supplied to an i−2$^{nd}$ scan line Si−2.

Explaining the operation process, if the scan signal is first supplied to the i−2$^{nd}$ scan line Si−2, the second common transistor CM2 and the fifth common transistor CM5 are turned on. If the second common transistor CM2 is turned on, the initial power Vint is supplied to the pixel 140. If the fifth common transistor CM5 is turned on, the low power VL is supplied to the gate electrode of the first common transistor CM1. Here, the voltage of the low power supply VL is set as a low voltage by which the first common transistor CM1 can be turned off.

Therefore, the first common transistor CM1 receiving the low power VL maintains a turn-off state. At this time, the third capacitor C3 is charged with voltage by which the first common transistor CM1 can be turned off. Thereafter, the first common transistor CM1 maintains a turn-off state by corresponding to the voltage charged in the third capacitor C3.

Meanwhile, if the scan signal is supplied to the i+1$^{st}$ scan line Si+1, the fourth common transistor CM4 is turned on. If the fourth common transistor CM4 is turned on, the voltage of the first power supply ELVDD is supplied to the gate electrode of the first common transistor CM1 so that the first common transistor CM1 is turned on. If the first common transistor CM1 is turned on, the voltage of the first power supply ELVDD is supplied to the pixel 140.

Meanwhile, if the supply of the scan signal to the i+1$^{st}$ scan line Si+1 is suspended, the fourth common transistor CM4 is turned off. In this case, the voltage of the gate electrode of the first common transistor maintains the voltage of the first power supply ELVDD by means of the third capacitor C3. Therefore, the first common transistor CM1 supplies the voltage of the first power supply ELVDD to the pixel 140, while maintaining the turn-on state.

While the present invention has been described in connection with certain exemplary embodiments, it is to be understood that the invention is not limited to the disclosed embodiment, but, on the contrary, is intended to cover various modifications and equivalent arrangements included within the spirit and scope of the appended claims, and equivalents thereof.

What is claimed is:

1. An organic light emitting display device, comprising:

a scan driver sequentially supplying scan signals to scan lines;

a data driver supplying data signals to data lines when the scan signals are supplied;

pixels positioned at the intersections of the scan lines and the data lines; and a common circuit unit formed in every horizontal line, receiving power from one or more external power sources required in driving the pixels and transferring the received external power to pixels positioned in the same horizontal lines, wherein respective pixels positioned in an i$^{th}$ (i is a natural number) horizontal line include:

an organic light emitting diode whose cathode electrode is connected to a second power supply;

a first transistor whose first electrode is connected to the common circuit unit and second electrode is connected to an anode electrode of the organic light emitting diode to control the amount of current supplied to the organic light emitting diode;

a second transistor connected between the data line and a gate electrode of the first transistor and turned on when a scan signal is supplied to an i$^{th}$ scan line;

a third transistor connected between the first electrode of the first transistor and the gate electrode thereof and turned on when a scan signal is supplied to an i−1$^{st}$ scan line;

a first capacitor connected between the gate electrode of the first transistor and the anode electrode of the organic light emitting diode; and a second capacitor connected between the anode electrode of the organic light emitting diode and a fixed power supply.

2. The organic light emitting display device according to claim 1, wherein the fixed power supply is a direct current power supply.

3. The organic light emitting display device according to claim 2, wherein the fixed power supply is the second power supply.

4. The organic light emitting display device according to claim 1, wherein the scan driver sequentially supplies light emitting control signals having voltage at which transistors are turned off to light emitting control lines.

5. The organic light emitting display device according to claim 4, wherein a light emitting control signal supplied to an i$^{th}$ light emitting control line overlaps with a scan signal supplied to an i−2$^{nd}$ scan line, the i−1$^{st}$ scan line and the i$^{th}$ scan line.

6. The organic light emitting display device according to claim 4, wherein the common circuit unit positioned in the i$^{th}$ horizontal line includes a first common transistor connected between a first power supply and the first electrode of the first transistor and turned off when a light emitting control signal is supplied to the i$^{th}$ light emitting control line;

a second common transistor connected between an initial power supply and the first electrode of the first transistor and turned on when a scan signal is supplied to the i−2$^{nd}$ scan line; and a third common transistor connected between a reference power supply and the first electrode of the first transistor and turned on when a scan signal is supplied to the i−1$^{st}$ can line.

7. The organic light emitting display device according to claim 4, wherein the respective pixels positioned in the i$^{th}$ horizontal line further include a fourth transistor connected between the reference power supply and the first electrode of the first transistor and turned on when a scan signal is supplied to the i−1$^{st}$ scan line.

8. The organic light emitting display device according to claim 7, wherein the common circuit unit positioned in the i$^{th}$ horizontal line includes:

a first common transistor connected between a first power supply and the first electrode of the first transistor and turned off when a light emitting control signal is supplied to the i$^{th}$ light emitting control line; and a second common transistor connected between an initial power supply and the first electrode of the first transistor and turned on when a scan signal is supplied to the i−2$^{nd}$ scan line.

9. The organic light emitting display device according to claim 7, wherein the respective pixels positioned in the i$^{th}$ horizontal line further include a fifth transistor connected between an initial power supply and the first electrode of the first transistor and turned on when a scan signal is supplied to the i−2$^{nd}$ scan line.

10. The organic light emitting display device according to claim 9, wherein the common circuit unit positioned in the i$^{th}$ horizontal line includes:

a first common transistor connected between a first power supply and the first electrode of the first transistor and turned off when a light emitting control signal is supplied to the i$^{th}$ light emitting control line.

11. The organic light emitting display device according to claim 7, wherein the respective pixels positioned in the i$^{th}$ horizontal line further include a fifth transistor connected between an initial power supply and the anode electrode of the organic light emitting diode and turned on when a scan signal is supplied to the i−2$^{nd}$ scan line.

12. The organic light emitting display device according to claim 11, wherein the common circuit unit positioned in the i$^{th}$ horizontal line includes:

a first common transistor connected between a first power supply and the first electrode of the first transistor and turned off when a light emitting control signal is supplied to the i$^{th}$ light emitting control line.

13. The organic light emitting display device according to claim 1, wherein a common circuit unit positioned in the $i^{th}$ horizontal line includes:

a first common transistor connected between a first power supply and the first electrode of the first transistor;

a second common transistor connected between an initial power supply and the first electrode of the first transistor and turned on when a scan signal is supplied to an $i-2^{nd}$ scan line;

a third common transistor connected between a reference power supply and the first electrode of the first transistor and turned on when a scan signal is supplied to the $i-1^{st}$ scan line;

a fourth common transistor connected between the first power supply and the gate electrode of the first common transistor and turned on when a scan signal is supplied to an $i+1^{st}$ scan line;

a fifth common transistor connected between the gate electrode of the first common transistor and a low power supply and turned on when a scan signal is supplied to the $i-2^{nd}$ scan line; and a third capacitor connected between the gate electrode of the first common transistor and the first power supply.

14. The organic light emitting display device according to claim 13, wherein the low power supply is set to voltage at which the first common transistor is turned off.

15. The organic light emitting display device according to claim 6, wherein the reference power supply is set to voltage lower than the first power supply and higher than the initial power supply.

16. The organic light emitting display device according to claim 15, wherein the voltage obtained by subtracting the threshold voltage of the first transistor from the voltage of the reference power supply is set to voltage lower than the threshold voltage of the organic light emitting diode.

17. An organic light emitting display device, comprising:

a scan driver sequentially supplying scan signals to scan lines;

a data driver supplying data signals to data lines when the scan signals are supplied; and a common circuit unit formed in every horizontal line, receiving power from one or more external power sources required in driving a plurality of pixels positioned at the intersections of the scan lines and the data lines, said common circuit unit transfers the received external power to pixels positioned in a same horizontal line, wherein respective pixels of said plurality of pixels are positioned in an $i^{th}$ (i is a natural number) horizontal line and further comprise:

an organic light emitting diode whose cathode electrode is connected to a second power supply;

a first transistor whose first electrode is connected to the common circuit unit and second electrode is connected to an anode electrode of the organic light emitting diode to control the amount of current supplied to the organic light emitting diode;

a second transistor connected between the data line and a gate electrode of the first transistor and turned on when a scan signal is supplied to an $i^{th}$ scan line;

a third transistor connected between the first electrode of the first transistor and the gate electrode thereof and turned on when a scan signal is supplied to an $i-1^{st}$ scan line;

a first capacitor connected between the gate electrode of the first transistor and the anode electrode of the organic light emitting diode; and a second capacitor connected between the anode electrode of the organic light emitting diode and a fixed power supply.

18. An organic light emitting display device, comprising:

a scan driver sequentially supplying scan signals to scan lines;

a data driver supplying data signals to data lines when the scan signals are supplied;

pixels positioned at the intersections of the scan lines and the data lines, the pixels each including a first transistor for controlling the amount of current supplied to an organic light emitting diode; and a common circuit unit formed in every horizontal line, receiving power from one or more external power sources required in driving the pixels and transferring the received external power to pixels positioned in a same horizontal line, said common circuit unit positioned in the $i^{th}$ horizontal line comprising:

a first common transistor connected between a first power supply and a first electrode of a first transistor;

a second common transistor connected between an initial power supply and the first electrode of the first transistor and turned on when a scan signal is supplied to an $i-2^{nd}$ scan line;

a third common transistor connected between a reference power supply and the first electrode of the first transistor and turned on when a scan signal is supplied to the $i-1^{st}$ scan line;

a fourth common transistor connected between the first power supply and the gate electrode of the first common transistor and turned on when a scan signal is supplied to an $i+1^{st}$ scan line;

a fifth common transistor connected between the gate electrode of the first common transistor and a low power supply and turned on when a scan signal is supplied to the $i-2^{nd}$ scan line; and a third capacitor connected between the gate electrode of the first common transistor and the first power supply.

* * * * *